US011788365B2

(12) United States Patent
Roselier et al.

(10) Patent No.: US 11,788,365 B2
(45) Date of Patent: Oct. 17, 2023

(54) EXPANDABLE METAL PACKER SYSTEM WITH PRESSURE CONTROL DEVICE

(71) Applicant: Saltel Industries, Bruz (FR)

(72) Inventors: Samuel Roselier, Bruz (FR); Romain Neveu, Bruz (FR)

(73) Assignee: SALTEL INDUSTRIES SAS, Bruz (FR)

( * ) Notice: Subject to any disclaimer, the term of this patent is extended or adjusted under 35 U.S.C. 154(b) by 85 days.

(21) Appl. No.: 17/424,188

(22) PCT Filed: Jan. 23, 2020

(86) PCT No.: PCT/EP2020/051612
§ 371 (c)(1),
(2) Date: Jul. 20, 2021

(87) PCT Pub. No.: WO2020/152262
PCT Pub. Date: Jul. 30, 2020

(65) Prior Publication Data

US 2022/0090455 A1 Mar. 24, 2022

(30) Foreign Application Priority Data

Jan. 23, 2019 (EP) ..... 19305085

(51) Int. Cl.
*E21B 33/127* (2006.01)
*E21B 23/01* (2006.01)
(Continued)

(52) U.S. Cl.
CPC ..... *E21B 23/01* (2013.01); *E21B 23/04* (2013.01); *E21B 23/06* (2013.01); *E21B 33/127* (2013.01);
(Continued)

(58) Field of Classification Search
CPC ..... E21B 33/1285; E21B 33/127
See application file for complete search history.

(56) References Cited

U.S. PATENT DOCUMENTS 8,800,670 B2 8/2014 Lembcke et al.
9,206,666 B2 12/2015 Hallundbaek et al.
(Continued)

FOREIGN PATENT DOCUMENTS

EP 2206879 A1 7/2010
EP 3088654 A1 11/2016
(Continued)

OTHER PUBLICATIONS

International Search Report and Written Opinion issued in PCT Application PCT/EP2020/051612, dated Mar. 18, 2020 (16 pages).

*Primary Examiner* — Cathleen R Hutchins
(74) *Attorney, Agent, or Firm* — Jeffrey D. Frantz

(57) ABSTRACT

A technique facilitates utilization of a packer (34) in a borehole (32) or within other tubular structures. The packer may be constructed for mounting about a generally tubular base pipe (36). The packer generally comprises a metal sleeve (40) combined with extremities (44) located at each axial end of the metal sleeve. The metal sleeve (40) maintains a seal once expanded to a surrounding wellbore wall, e.g. a casing wall. For example, the metal sleeve (40) may be combined with an elastomer along its exterior, the elastomer sealing against the surrounding wellbore wall when the metal sleeve is radially expanded. Additionally, a device, e.g. a valve (62), is employed to control the pressures acting on the metal sleeve. For example, the device may be in the form of a valve operable (62) to control pressures acting on the metal sleeve (40) while miming-in-hole, during expansion of the metal sleeve, and after setting of the packer.

19 Claims, 14 Drawing Sheets

(51) Int. Cl.

| | |
|---|---|
| ***E21B 23/04*** | (2006.01) |
| ***E21B 23/06*** | (2006.01) |
| ***E21B 33/128*** | (2006.01) |
| ***E21B 34/06*** | (2006.01) |
| ***E21B 34/10*** | (2006.01) |

(52) U.S. Cl.
CPC ..... *E21B 33/128* (2013.01); *E21B 34/063* (2013.01); *E21B 34/102* (2013.01)

(56) References Cited

U.S. PATENT DOCUMENTS

| | | | | |
|---|---|---|---|---|
| 9,359,860 | B2 | 6/2016 | Hallundbaek et al. | |
| 10,844,686 | B2 | 11/2020 | Hallundbaek et al. | |
| 2011/0266004 | A1* | 11/2011 | Hallundbaek | E21B 33/1285 166/387 |
| 2016/0341003 | A1 | 11/2016 | Saltel et al. | |
| 2017/0211347 | A1 | 7/2017 | Vasques | |
| 2018/0148992 | A1* | 5/2018 | Vasques | E21B 33/127 |
| 2018/0202259 | A1* | 7/2018 | Tanguy | E21B 34/063 |
| 2020/0173245 | A1† | 6/2020 | Prasad | |

FOREIGN PATENT DOCUMENTS

| | | | |
|---|---|---|---|
| WO | 2015169959 | A2 | 11/2015 |
| WO | 2018178053 | A1 | 10/2018 |
| WO | 2020115011 | A1 | 6/2020 |

* cited by examiner
† cited by third party

EXPANDABLE METAL PACKER SYSTEM WITH PRESSURE CONTROL DEVICE

BACKGROUND

In many well applications, packers are used to seal off sections of a wellbore. The packers are delivered downhole via a well string and then set against the surrounding wellbore surface to provide annular barriers between the adjacent uphole and downhole sections of wellbore. In various applications, each packer comprises an elastomeric element which may be expanded radially into sealing engagement with the surrounding borehole surface. Additionally, some applications utilize an expandable metal packer or packers. Such expandable metal packers use a deformable metal membrane which is deformed permanently by the pressure of inflating fluid. In some applications, however, pressure acting on the metal membrane can be difficult to control and the metal membrane is susceptible to damage.

SUMMARY

In general, a system and methodology are provided for utilizing a packer in a borehole or within other tubular structures. The packer may be constructed for mounting about a generally tubular base pipe. The packer generally comprises a metal sleeve combined with extremities located at each axial end of the metal sleeve. The metal sleeve maintains a seal once expanded to a surrounding wellbore wall, e.g. a casing wall. For example, the metal sleeve may be combined with an elastomer along its exterior, the elastomer sealing against the surrounding wellbore wall when the metal sleeve is radially expanded. Additionally, a device, e.g. a valve, is employed to control the pressures acting on the metal sleeve. For example, the device may be in the form of a valve operable to control pressures acting on the metal sleeve while running-in-hole, during expansion of the metal sleeve, and after setting of the packer.

However, many modifications are possible without materially departing from the teachings of this disclosure. Accordingly, such modifications are intended to be included within the scope of this disclosure as defined in the claims.

BRIEF DESCRIPTION OF THE DRAWINGS

Certain embodiments of the disclosure will hereafter be described with reference to the accompanying drawings, wherein like reference numerals denote like elements. It should be understood, however, that the accompanying figures illustrate the various implementations described herein and are not meant to limit the scope of various technologies described herein, and.

DETAILED DESCRIPTION

Figure 1:
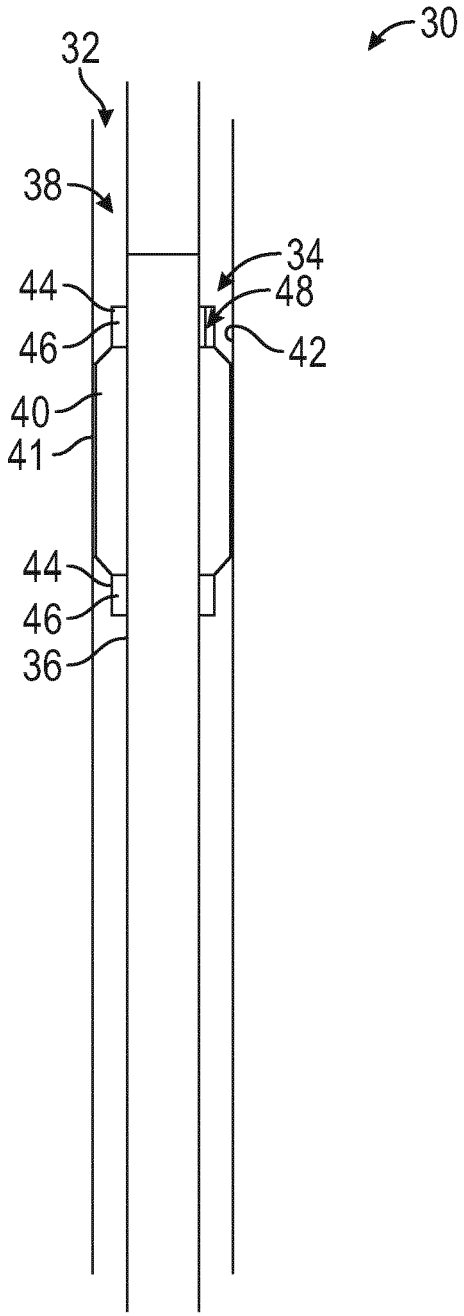
FIG. 1 is an illustration of an example of an expandable metal packer mounted along a tubing string and set in a borehole and having a pressure control device, e.g. a valve, according to an embodiment of the disclosure.

In the following description, numerous details are set forth to provide an understanding of some embodiments of the present disclosure. However, it will be understood by those of ordinary skill in the art that the system and/or methodology may be practiced without these details and that numerous variations or modifications from the described embodiments may be possible.

The disclosure herein generally involves a system and methodology for utilizing a packer in a borehole or within other tubular structures. For example, one or more of the packers may be deployed downhole into a wellbore via a well string. The packer or packers may then be actuated to a set position to form a seal with the surrounding wellbore surface, e.g. an interior casing surface or an open hole surface, and to isolate sections of the annulus along the well string.

By way of example, the packer may be an expandable metal packer constructed with a metal sealing element. The metal sealing element may be in the form of a metal sleeve combined with an elastomeric seal element. The metal sealing element may be mounted around a base pipe which may be part of a well string, e.g. a drilling string, or other tubing string. When the packer is positioned at a desired location within the borehole or other tubular structure, the metal sealing element may be expanded under fluid pressure to move the elastomeric seal element into sealing engagement with a surrounding wall surface. For example, the metal sealing element may comprise a permanently deformable metal bladder, e.g. a metal membrane, which is deformed downhole via the fluid pressure, e.g. hydroforming.

According to an embodiment, a system and methodology are provided for utilizing a packer in a borehole or within other tubular structures. The packer may be constructed for mounting about a generally tubular base pipe. In general, the packer comprises a metal sleeve combined with extremities located at each axial end of the metal sleeve. The metal sleeve maintains a seal once expanded to a surrounding wellbore wall, e.g. a casing wall. For example, the metal sleeve may be combined with an elastomer along its exterior, the elastomer sealing against the surrounding wellbore wall when the metal sleeve is radially expanded. Additionally, a device, e.g. valve, is operable to control pressures acting on the metal sleeve while the packer is run-in-hole, during expansion of the metal sleeve, and after setting of the packer.

In this embodiment, the pressure control device may be actuated to ensure there is no fluid communication between an inside of the base pipe and the surrounding annulus while running-in-hole. However, fluid communication between the packer inside diameter (packer interior) and the annulus is allowed. At a first preset pressure applied to the pressure control device, fluid communication between the packer interior and the annulus is closed. Additionally, fluid communication between the inside of the base pipe and the packer interior is opened to enable packer expansion, i.e. expansion of the metal sleeve.

At a second preset pressure, fluid communication between the inside of the base pipe and the annulus may be permanently closed. Additionally, fluid communication between the packer interior and the annulus may be re-opened so as to compensate annulus pressure inside the packer and to improve its differential pressure rating. In some embodiments, however, the pressure may be trapped inside the packer.

Referring generally to FIG. 1, an example of a well system 30 is illustrated as deployed in a borehole 32, e.g. a wellbore. The well system 30 comprises an expandable metal packer 34 mounted along a base pipe 36 which may be part of an overall tubing string 38, e.g. a well production or casing string. The packer 34 may comprise an expandable metal sleeve 40 which is combined with a seal element 41 to serve as a sealing structure which can be expanded for sealing engagement with a surrounding borehole wall surface 42, e.g. a surrounding casing or open hole wellbore wall surface.

The expandable metal sleeve 40 is disposed between extremities 44. For example, the extremities 44 may be coupled with the expandable metal sleeve 40 and positioned with one extremity 44 on each axial end of the expandable metal sleeve 40. Each extremity 44 may comprise a metal collar 46 positioned around the base pipe 36. During mounting of packer 34 along tubing string 38, the metal collars 46 may be plastically deformed, e.g. crimped, to secure the packer 34 to the base pipe 36.

The packer 34 further comprises a pressure control device 48 positioned at a suitable location in packer 34. For example, the pressure control device 48 may be located within or combined with one of the extremities 44. As described in greater detail below, the pressure control device 48 may comprise a valve actuatable between different operational positions to control the pressure acting on expandable metal sleeve 40 during various stages of deployment and use of packer 34. According to certain embodiments, the pressure control device 48 may be selectively actuated via application of preset pressure levels along, for example, an interior of the tubing string 38 and base pipe 36. However, other types of inputs could be used to control actuation of the pressure control device 48.

Depending on the application, the expandable metal sleeve 40 may comprise a metal membrane, e.g. a bladder, or other metal structure which may be plastically deformed into a permanent expanded structure engaging the surrounding wall surface 42. In some embodiments, the metal sleeve 40 is expanded via fluid pressure, e.g. via a hydroforming process. For example, high pressure fluid may be delivered along an interior of tubing string 38 and directed into an interior of the expandable metal sleeve 40 via a passage or passages extending through a wall of base pipe 36 working in cooperation with pressure control device 48.

Figure 2:
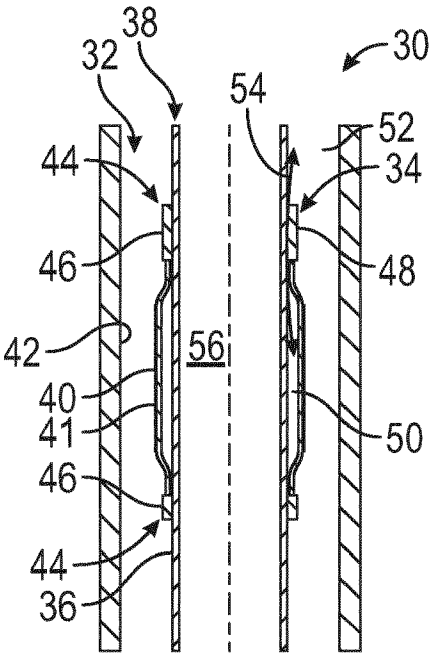
FIG. 2 is a schematic illustration of an example of a packer mounted along a base pipe, according to an embodiment of the disclosure.

Referring generally to FIG. 2, a schematic illustration is provided of an embodiment of the expandable metal packer 34. In this example, the metal sleeve 40 is illustrated in a radially contracted position prior to setting of expandable metal packer 34 during running-in-hole (RIH). At this operational stage, the pressure control device 48 is at a position which allows fluid communication between a packer interior 50 and an annulus 52 surrounding the tubing string 38, as represented by arrow 54. At the same time, the pressure control device 48 blocks fluid communication between an interior 56 of the base pipe 36 and the annulus 52.

Figure 3:
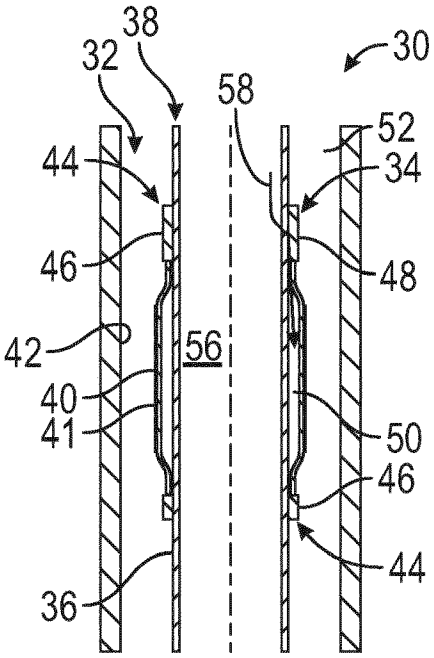
FIG. 3 is a schematic illustration similar to that of FIG. 2 but with the packer in a different operational configuration, according to an embodiment of the disclosure.

Once the packer 34 is delivered to a desired position in borehole 32, a preset pressure may be applied through base pipe interior 56 to the pressure control device 48. The preset pressure causes the pressure control device 48, e.g. valve, to actuate to an open position, as illustrated in FIG. 3. In this position, fluid communication between the packer interior 50 and the surrounding annulus 52 is closed. However, fluid communication between base pipe interior 56 and the packer interior 50 is opened, as represented by arrow 58.

Figure 5:
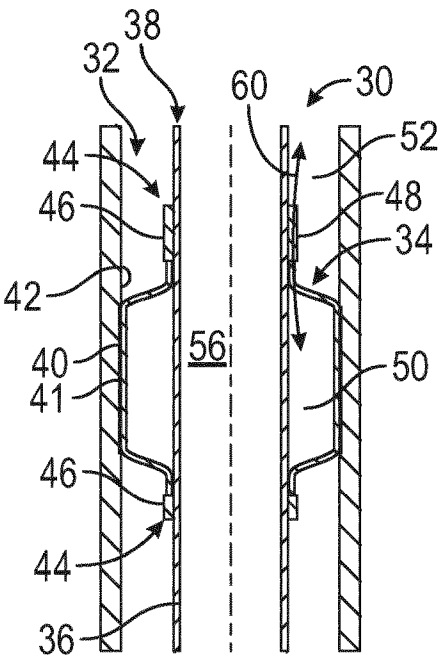
FIG. 5 is a schematic illustration similar to that of FIG. 4 but with the packer in a different operational configuration, according to an embodiment of the disclosure.
Figure 4:
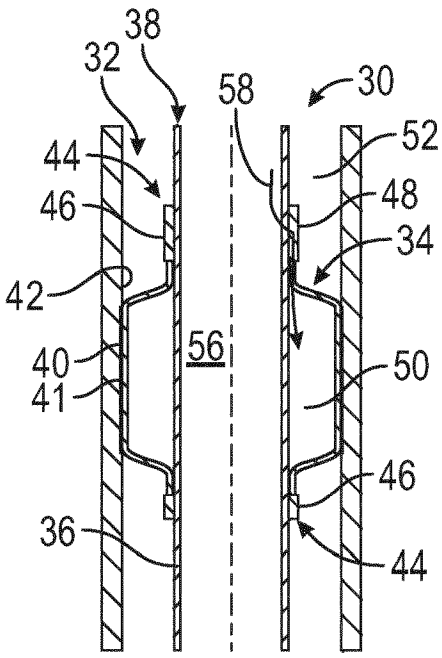
FIG. 4 is a schematic illustration similar to that of FIG. 3 but with the packer in a different operational configuration, according to an embodiment of the disclosure.

Pressurized fluid may then be applied down through the base pipe interior 56 to cause packer expansion via radial expansion of metal sleeve 40 against the surrounding wellbore wall surface 42, as illustrated in FIG. 4. By increasing the pressure in interior 56 to a second preset pressure level, the pressure control device 48 is actuated to another operational position. In this operational position, fluid communication between the base pipe interior 56 and the annulus 52 may be permanently closed. Additionally, fluid communication between the packer interior 50 and annulus 52 may be re-opened, as illustrated by arrow 60 in FIG. 5. The re-opening of communication between packer interior 50 and annulus 52 enables compensation for annulus pressure inside the packer 34 and improves the differential pressure rating of the packer 34. It should be noted that in some embodiments, the pressure control device 48 may be constructed so that pressure is trapped in packer interior 50.

Figure 6:
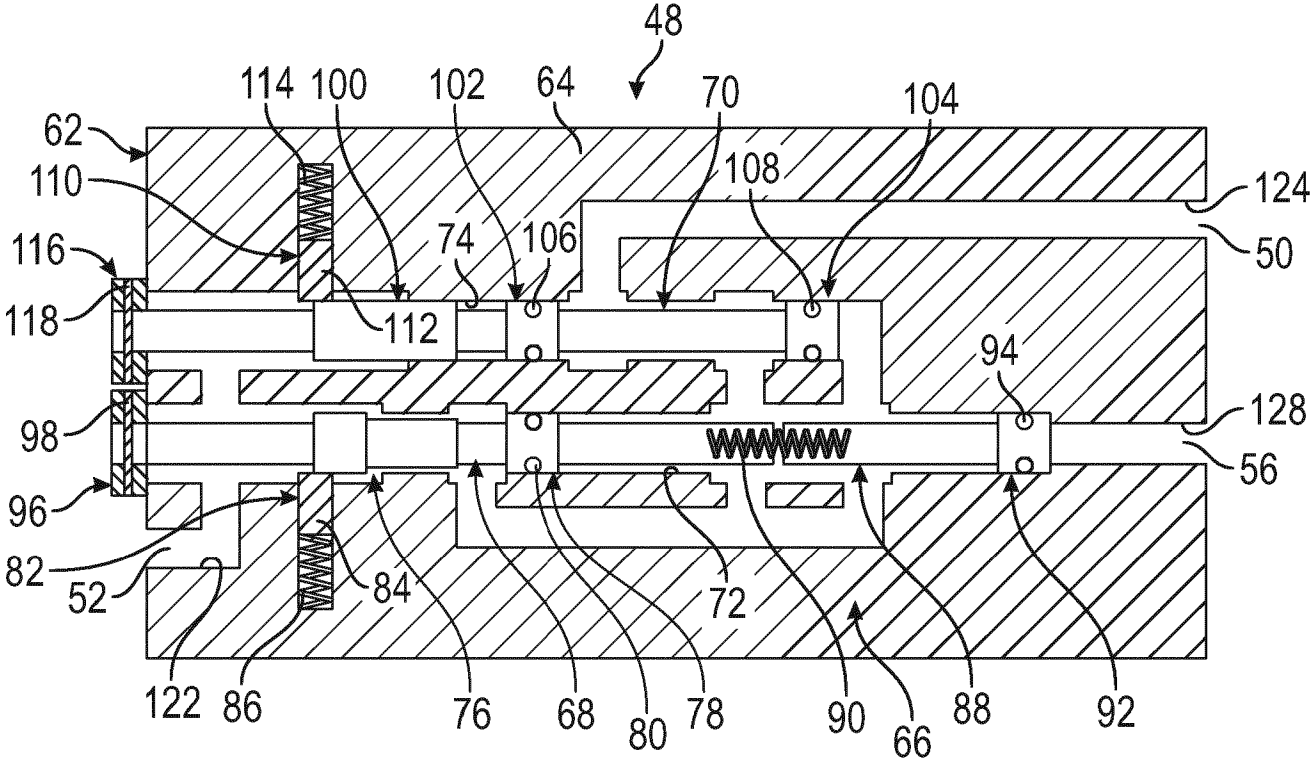
FIG. 6 is a schematic illustration of an example of a pressure control device that may be utilized in the packer, according to an embodiment of the disclosure.

Referring generally to FIG. 6, an embodiment of pressure control device 48 is illustrated. In this example, pressure control device 48 is in the form of a valve 62 having a valve housing 64 containing a hydraulic circuit 66. Additionally, an opening piston 68 and a closing and compensation piston 70 are slidably mounted within the valve housing 64 to enable control over fluid flow along the hydraulic circuit 66. In the example illustrated, the opening piston 68 is slidably mounted in a corresponding piston passage 72 which is part of the hydraulic circuit 66. Similarly, the closing and compensation piston 70 is slidably mounted in a corresponding piston passage 74 which is also part of the hydraulic circuit 66.

According to the embodiment illustrated, the opening piston 68 has differing diameters and includes expanded portions 76, 78, i.e. portions with larger diameters. In the specific example illustrated, the expanded portion 78 comprises a seal 80 positioned for selective sealing with a surrounding wall surface of the corresponding piston passage 72. The expanded portion 76 may have an intermediate diameter portion and a large diameter portion arranged for interaction with a piston locking device 82. By way of example, the locking device 82 may comprise a locking piston 84 biased toward the opening piston 68 by, for example, a spring 86.

The opening piston 68 also may be coupled with a check valve 88 via a spring member 90 or other suitable extension member. The check valve 88 comprises an expanded portion 92 having a seal 94 oriented for sealing engagement with the surrounding wall surface of the corresponding piston passage 72. Initially, the opening piston 68 may be held at a desired flow position by a retention member 96. By way of example, the retention member 96 may comprise a shear member 98, e.g. a rupture device such as a rupture wire.

Similarly, the closing and compensation piston 70 may have differing diameters and may include expanded portions 100, 102, 104, i.e. portions with larger diameters. In the specific example illustrated, the expanded portions 102, 104 comprise corresponding seals 106, 108 positioned for selective sealing with surrounding wall surfaces of the corresponding piston passage 74. The expanded portion 100 is positioned for interaction with a piston locking device 110. By way of example, the locking device 110 may comprise a locking piston 112 biased toward the closing and compensation piston 70 by, for example, a spring 114.

Figure 7:
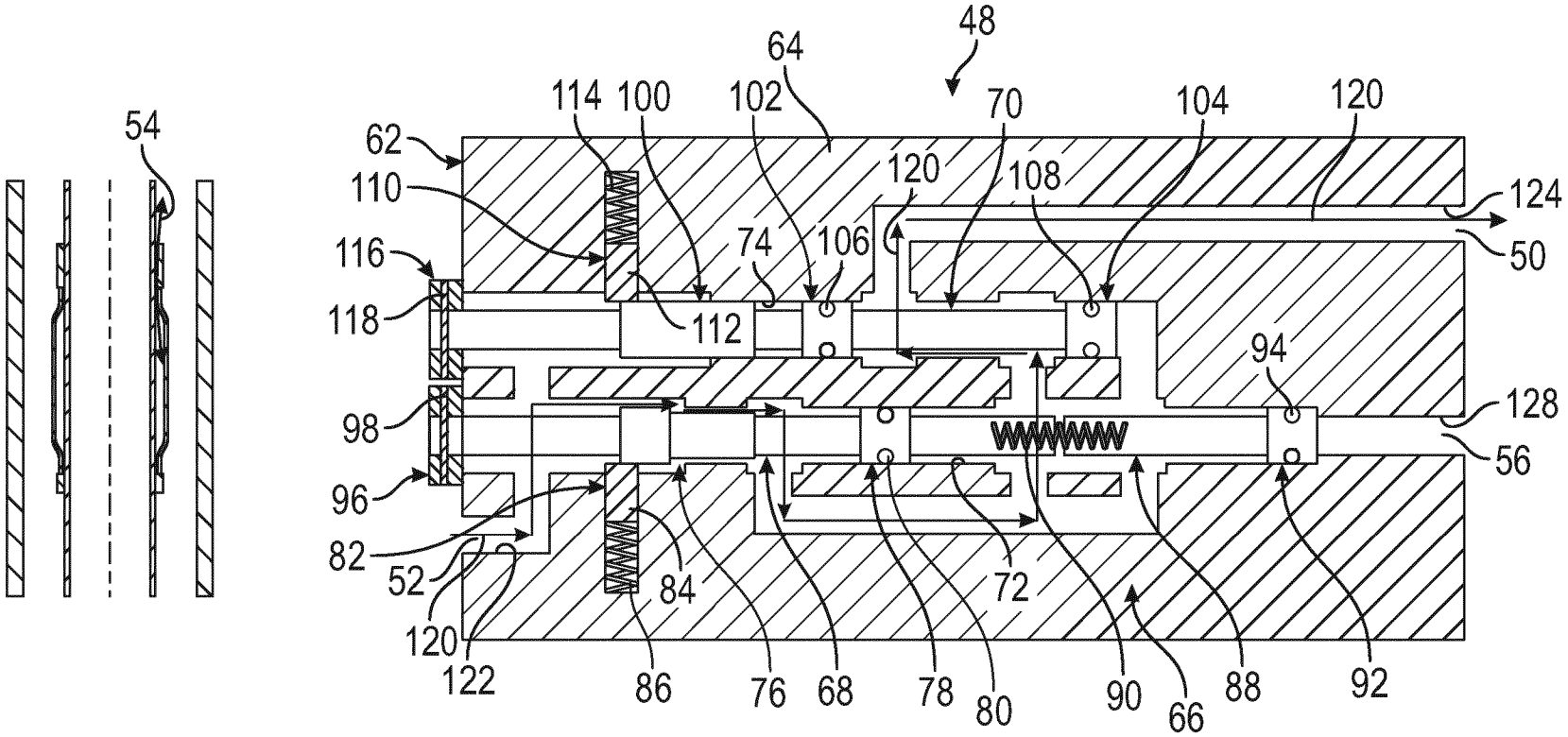
FIG. 7 is a schematic illustration similar to that of FIG. 6 but showing a flow path through the pressure control device, according to an embodiment of the disclosure.

Initially, the closing and compensation piston 70 may be held at a desired flow position by a retention member 116. By way of example, the retention member 116 may comprise a shear member 118, e.g. a rupture device such as a rupture wire. When the opening piston 68 and the closing and compensation piston 70 are held in the initial positions within hydraulic circuit 66, the hydraulic circuit 66 enables fluid communication between annulus 52 and packer interior 50, as represented by arrows 120 in FIG. 7.

As illustrated, the hydraulic circuit 66 is in fluid communication with the annulus 52 via a hydraulic circuit passage 122. The hydraulic circuit 66 also is in fluid communication with the packer interior 50 via hydraulic circuit passage 124. During this stage, fluid communication between the base pipe interior 56 and the annulus 52 is blocked by check valve 88. This configuration of valve 62 may be used when the packer 34 is run-in-hole to a desired position in borehole 32 as illustrated schematically in FIG. 2. It should be noted the arrows 120 representing flow along hydraulic circuit 66 are part of the flow represented by arrow 54 in FIG. 2.

Figure 8:
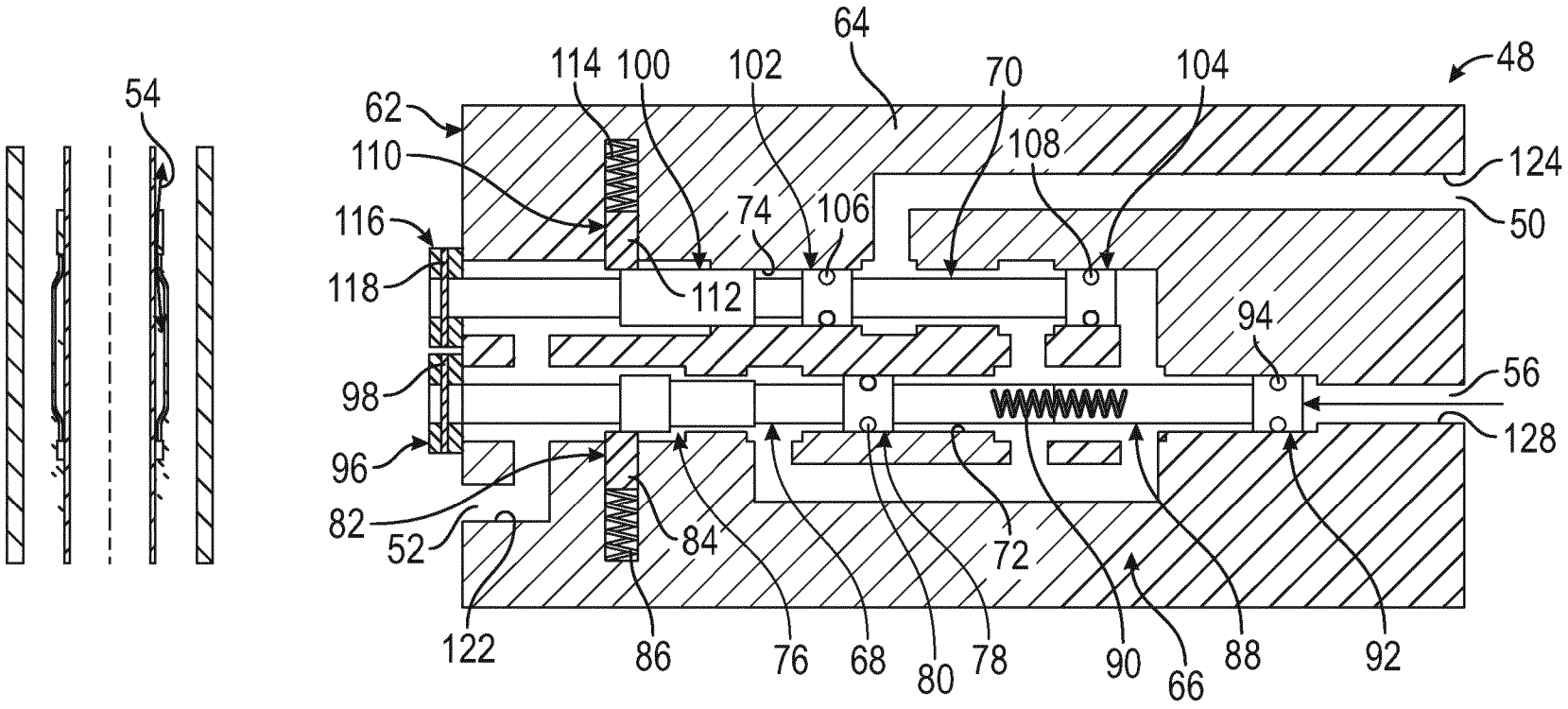
FIG. 8 is a schematic illustration similar to that of FIG. 7 but with the pressure control device during an initial stage of shifting to a different operational position, according to an embodiment of the disclosure.
Figure 9:
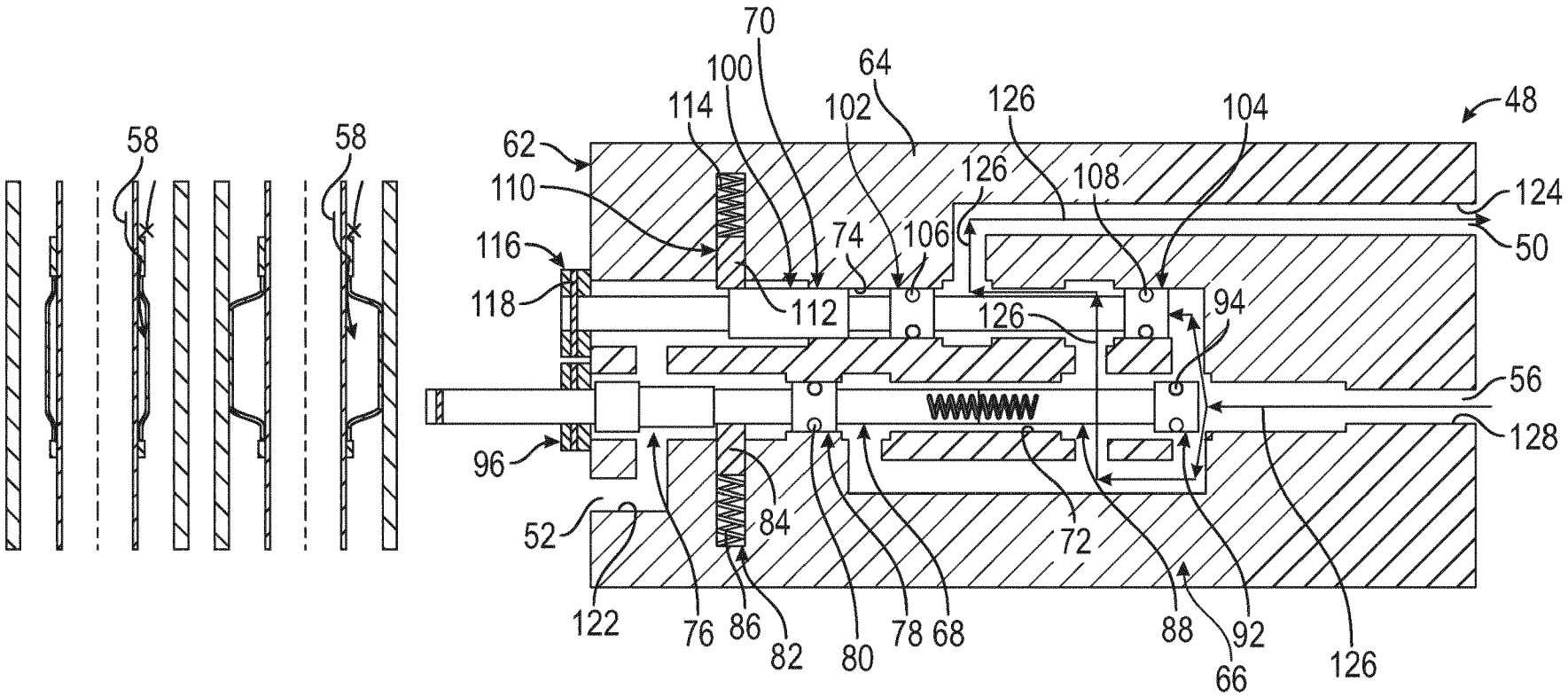
FIG. 9 is a schematic illustration similar to that of FIG. 8 but with the pressure control device in a different operational position, according to an embodiment of the disclosure.

As pressure is increased within interior 56 of base pipe 36, the check valve 88 is shifted toward opening piston 68 and compresses spring member 90, as illustrated in FIG. 8. To shift the opening piston 68, pressure in interior 56 is increased to the first preset pressure so as to release retention member 96 (e.g. to shear the shear member/rupture wire 98) and to shift opening piston 68, as illustrated in FIG. 9.

In this configuration, the expanded portion 78 and its seal 80 have been moved into sealing engagement with a portion of the surrounding wall surface forming corresponding piston passage 72. As a result, communication between the annulus 52 and the packer interior 50 is closed. However, communication between the base pipe interior 56 and the packer interior 50 is opened, as represented by arrows 126.

In this operational configuration of valve 62, the hydraulic circuit 66 is in fluid communication with base pipe interior 56 via a hydraulic circuit passage 128. It should be noted the arrows 126 representing flow along the hydraulic circuit 66 are part of the flow represented by arrow 58 in FIG. 3. In this configuration, hydraulic fluid under pressure may continually be provided along interior 56 of base pipe 36 to expand packer 34/metal sleeve 40 into sealing engagement with the surrounding wellbore wall 42 (see FIG. 4). Additionally, piston locking device 82 is activated to a position interacting with expanded portion 76, thus preventing movement of opening piston 68 back to its original position.

Figure 10:
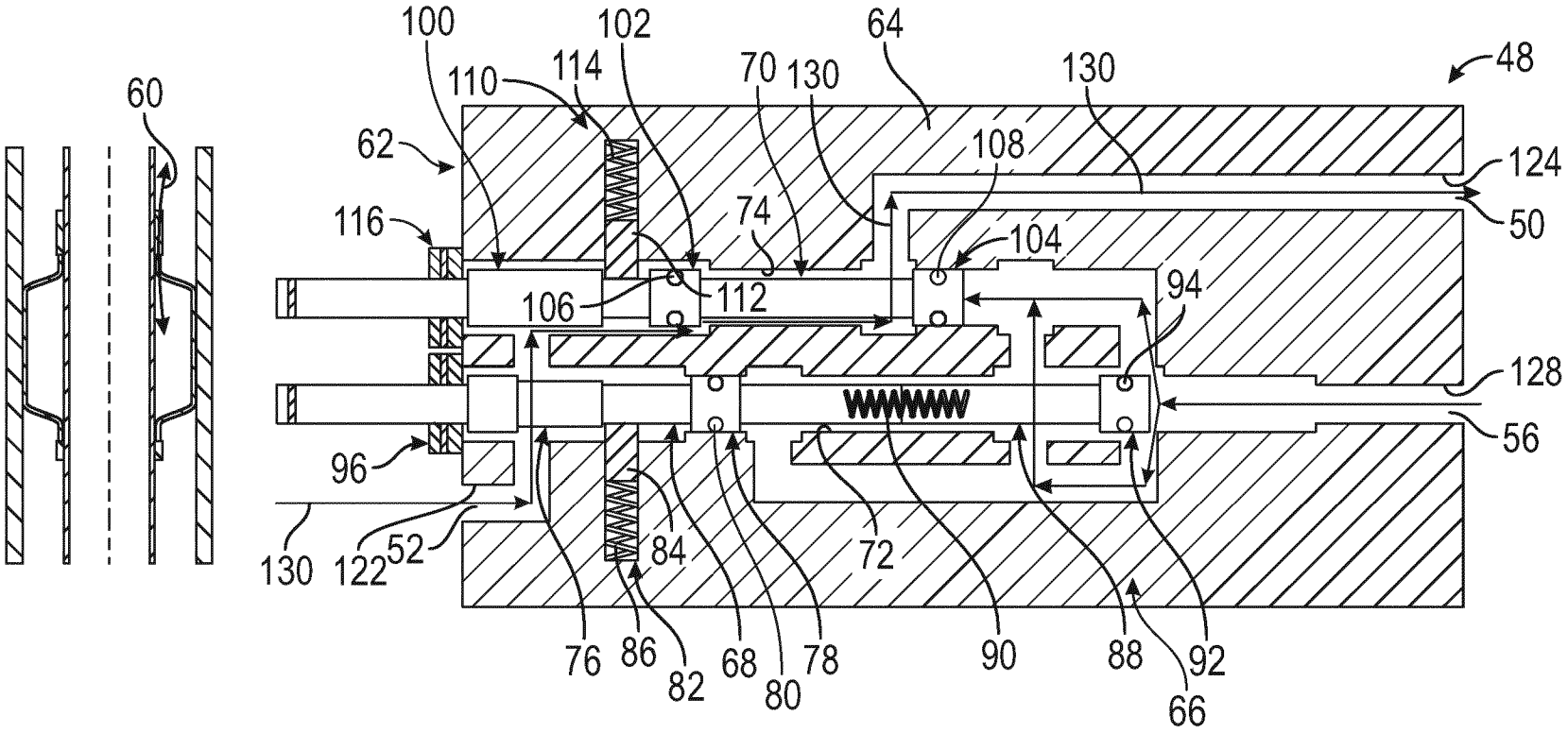
FIG. 10 is a schematic illustration similar to that of FIG. 9 but with the pressure control device in a different operational position, according to an embodiment of the disclosure.

After the packer 34 is set via expansion of metal sleeve 40, the pressure within base pipe 36 may be increased to the second preset pressure level so as to shift the closing and compensation piston 70. For example, increasing the pressure level to the second preset pressure level causes release of retention member 116 (e.g. shears the shear member/rupture wire 118) and shifting of closing and compensation piston 70, as illustrated in FIG. 10. If there are issues during packer expansion after the opening piston 68 has been opened (e.g. pump problems, leaks in the string providing pressure, or other expansion problems), the packer expandable sleeve 40 may be in a partially expanded state and pressure will be bled off. However, the check valve 88 is able to come back to its closed position and trap the fluid/pressure inside the packer 34. This will prevent the sleeve 40 from collapsing so that expansion can be resumed later.

In this configuration, the expanded portions 102, 104 and their corresponding seals 106, 108 have been moved into sealing engagement with portions of the surrounding wall surface forming corresponding piston passage 74. As a result, communication between the base pipe interior 56 and the packer interior 50 is closed. However, communication between the annulus 52 and the packer interior 50 is again opened, as represented by arrows 130. It should be noted the arrows 130 representing flow along the hydraulic circuit 66 are part of the flow represented by arrow 60 in FIG. 5. Additionally, piston locking device 110 is activated to a position interacting with expanded portion 100, thus preventing movement of closing and compensation piston 70 back to its original position.

Figure 11:
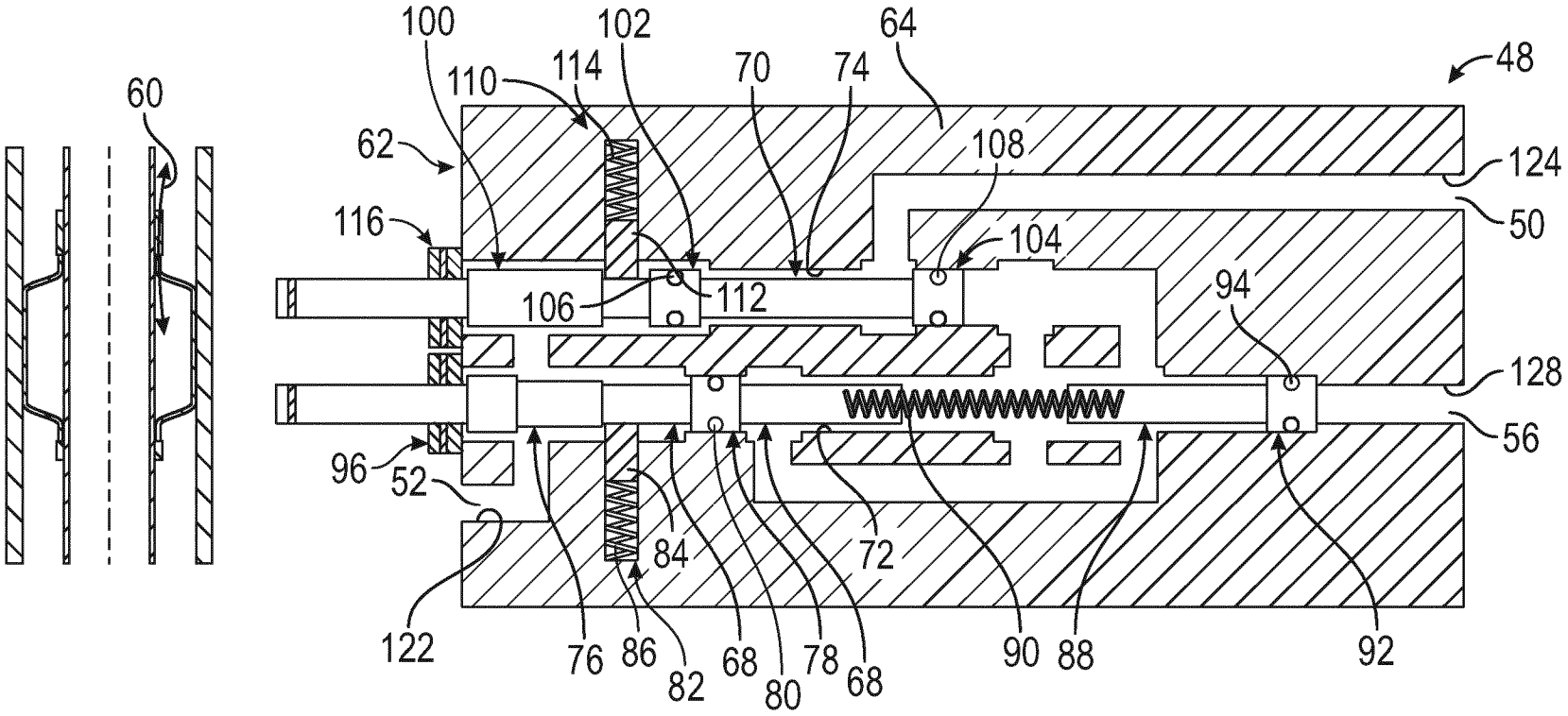
FIG. 11 is a schematic illustration similar to that of FIG. 10 but with the pressure control device in a different operational position, according to an embodiment of the disclosure.

When the pressure within base pipe interior 56 of base pipe 36 is released, the spring member 90 shifts check valve 88 and its seal 94 back into sealing engagement with the surrounding wall surface of corresponding piston passage 72, as illustrated in FIG. 11. However, a communication path between the annulus 52 and the packer interior 50 is maintained.

Figure 12:
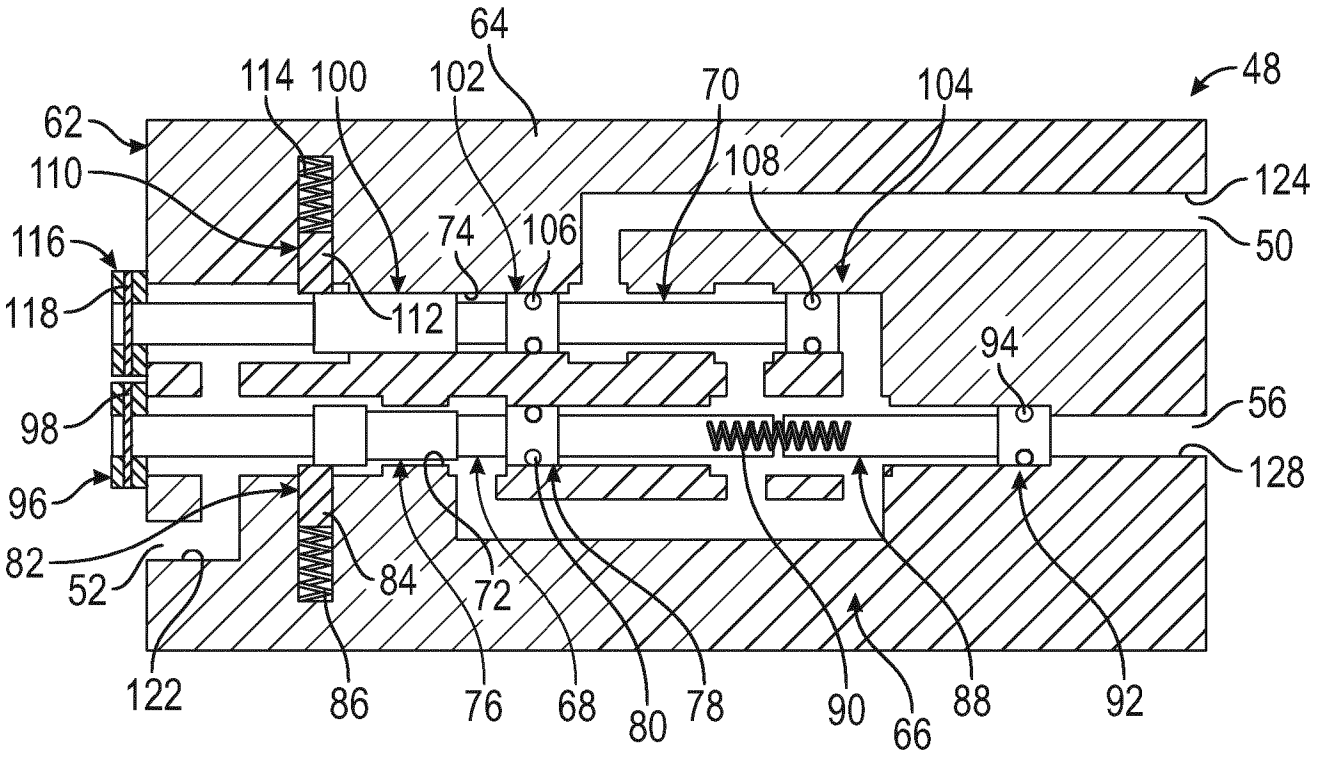
FIG. 12 is a schematic illustration of another embodiment of the pressure control device which may be used to maintain trapped fluid inside the packer after setting of the packer, according to an embodiment of the disclosure.

Referring generally to FIGS. 12-17, another embodiment of valve 62 is illustrated. In this embodiment, however, once the closing and compensation piston 70 has switched fluid within packer interior 50 is trapped rather than allowing the interior of packer 34 to communicate with the annulus 52. The embodiment illustrated in FIGS. 12-17 is very similar to the embodiment illustrated in FIGS. 6-11 and common reference numerals have been used for the same or similar components and features. With reference to FIG. 12, however, the contour of corresponding piston passage 74 has been changed such that the interaction of seals 106, 108 with the surrounding surface of piston passage 74 is able to trap fluid inside packer 34 after closure of the closing and compensation piston 70 (following setting of packer 34).

Figure 13:
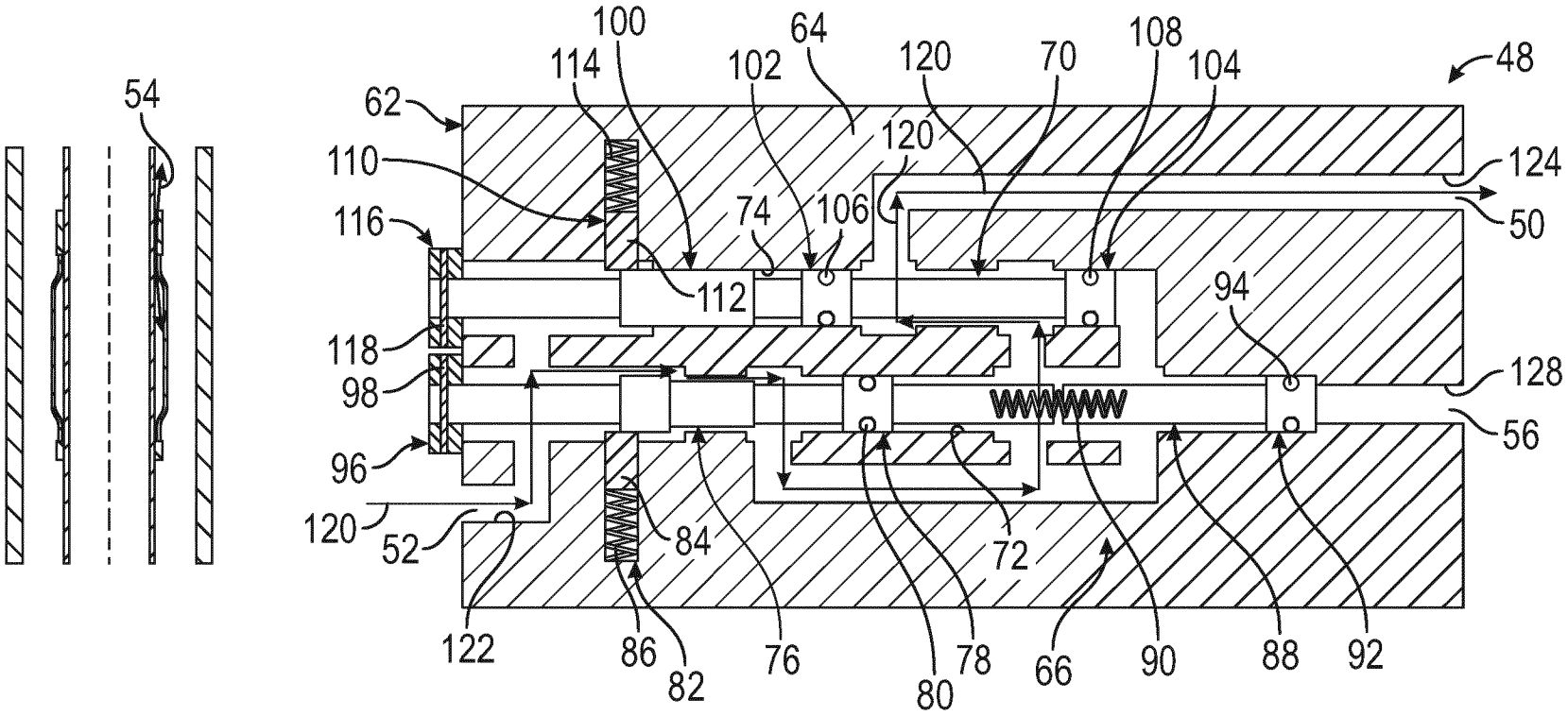
FIG. 13 is a schematic illustration similar to that of FIG. 12 but showing a flow path through the pressure control device, according to an embodiment of the disclosure.

In this example, the opening piston 68 and the closing and compensation piston 70 are again held at initial positions within hydraulic circuit 66 so as to enable fluid communication between annulus 52 and packer interior 50, as represented by arrows 120 in FIG. 13. During this stage, fluid communication between the base pipe interior 56 and the annulus 52 is blocked by check valve 88. This configuration of valve 62 may similarly be used when the packer 34 is run-in-hole to a desired position in borehole 32 as illustrated schematically in FIG. 2.

Figure 14:
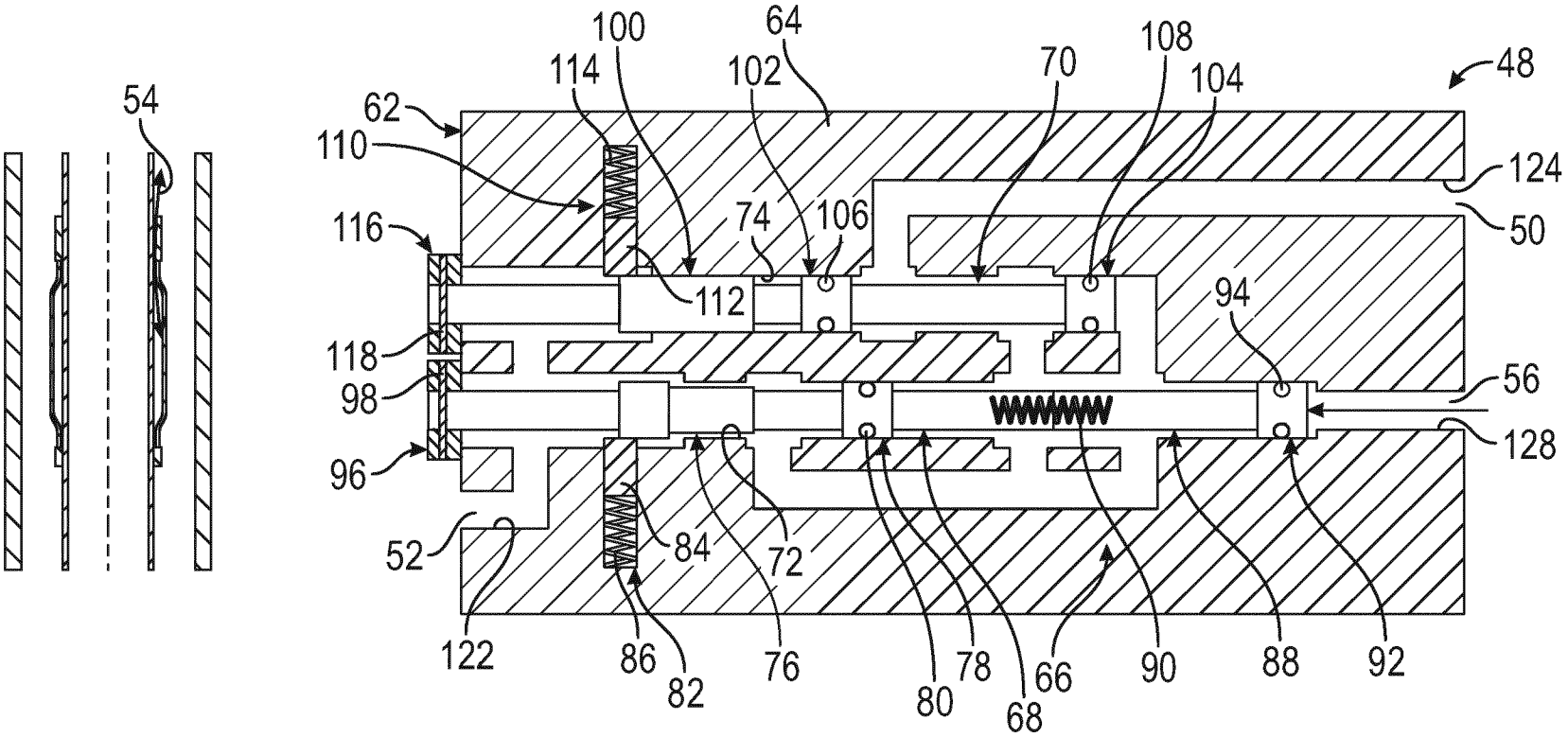
FIG. 14 is a schematic illustration similar to that of FIG. 13 but with the pressure control device in a different operational position, according to an embodiment of the disclosure.
Figure 15:
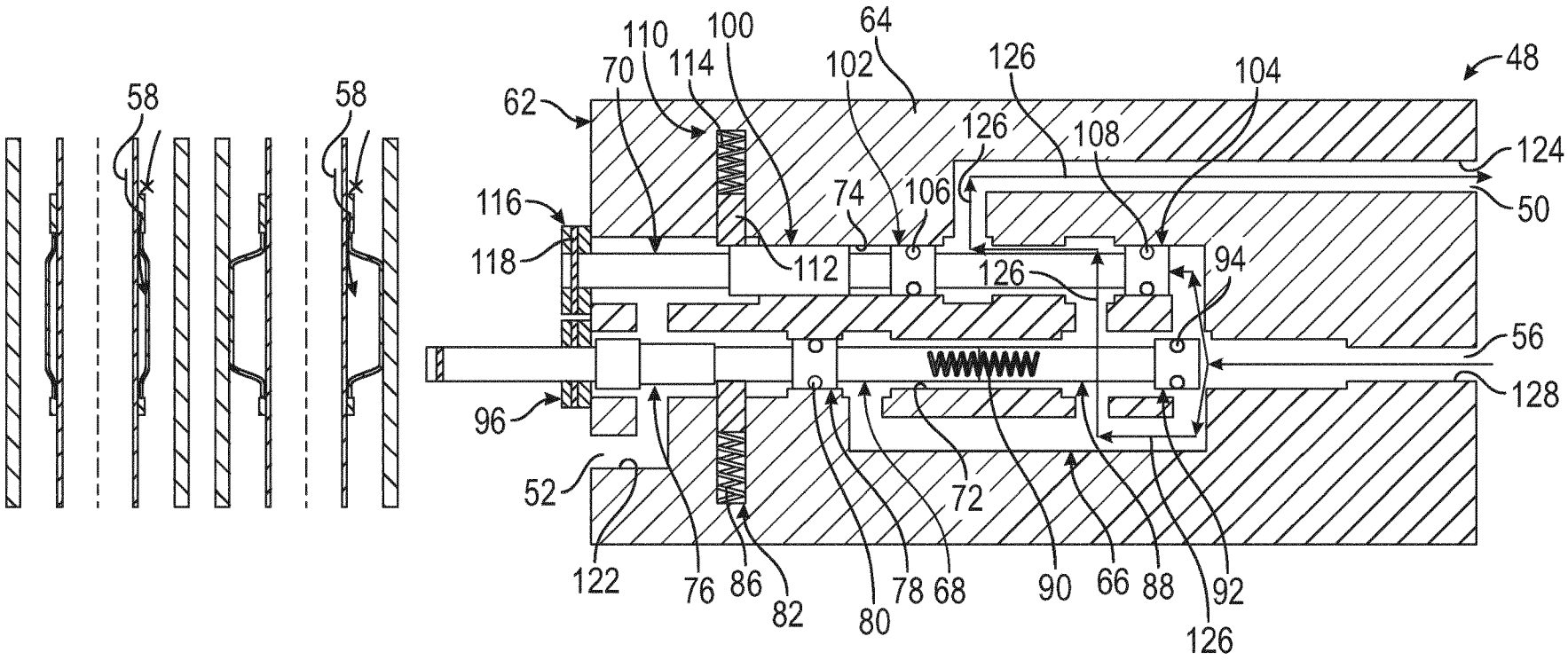
FIG. 15 is a schematic illustration similar to that of FIG. 14 but with the pressure control device in a different operational position, according to an embodiment of the disclosure.

As pressure is increased within interior 56 of base pipe 36, the check valve 88 is shifted toward opening piston 68 and compresses spring member 90, as illustrated in FIG. 14. To shift the opening piston 68, pressure in interior 56 is increased to the first preset pressure so as to release retention member 96 (e.g. to shear the shear member/rupture wire 98) and to shift opening piston 68, as illustrated in FIG. 15.

In this configuration, the expanded portion 78 and its seal 80 have been moved into sealing engagement with a portion of the surrounding wall surface forming corresponding piston passage 72. As a result, communication between the annulus 52 and the packer interior 50 is closed. However, communication between the base pipe interior 56 and the packer interior 50 is opened, as represented by arrows 126. Once valve 62 is in this operational position, hydraulic fluid under pressure may continually be provided along interior 56 of base pipe 36 to expand packer 34/metal sleeve 40 into sealing engagement with the surrounding wellbore wall 42 (see FIG. 4).

Figure 16:
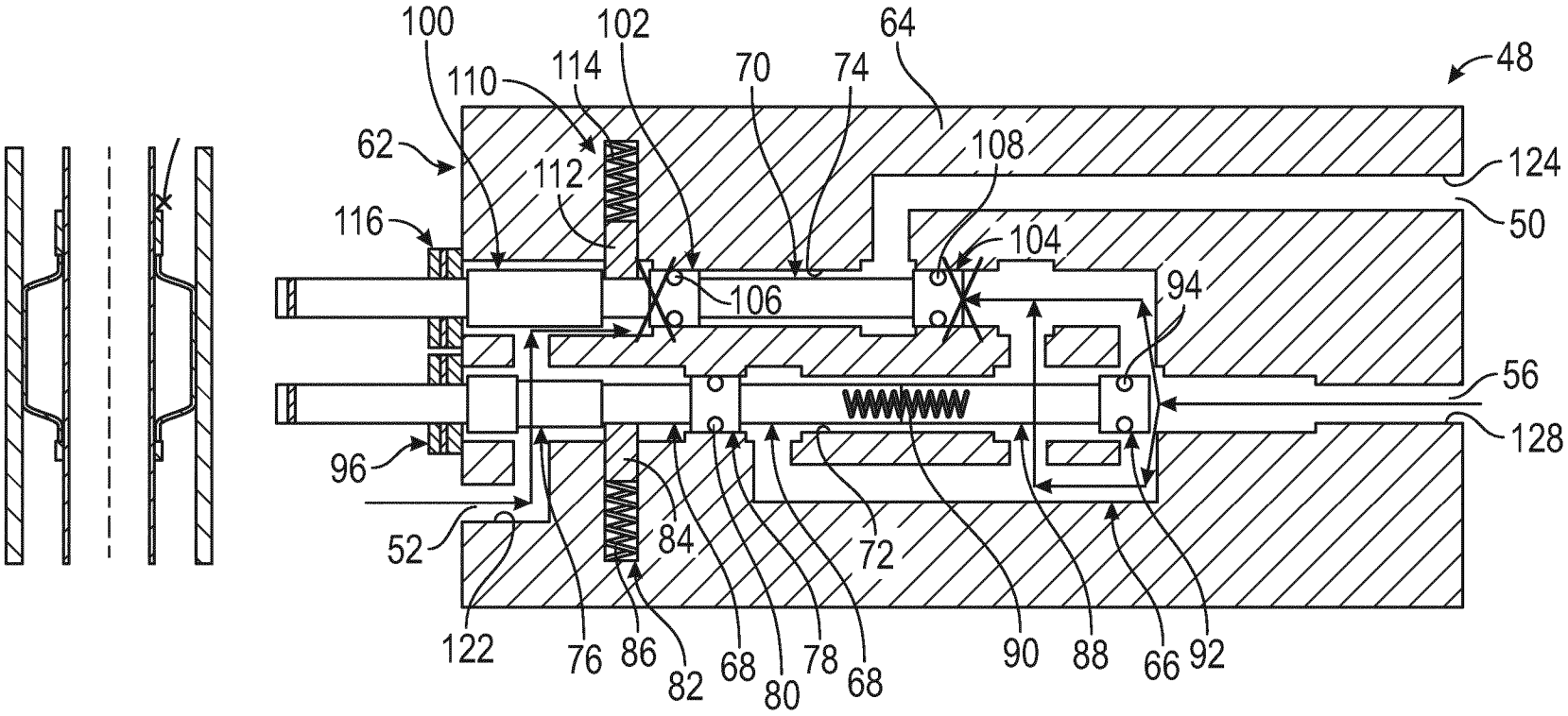
FIG. 16 is a schematic illustration similar to that of FIG. 15 but with the pressure control device in a different operational position, according to an embodiment of the disclosure.

Additionally, piston locking device 82 is activated to a position interacting with expanded portion 76, thus preventing movement of opening piston 68 back to its original position. After the packer 34 is set via expansion of metal sleeve 40, the pressure within base pipe 36 may be increased to the second preset pressure level so as to shift the closing and compensation piston 70. For example, increasing the pressure level to the second preset pressure level causes release of retention member 116 (e.g. shears the shear member/rupture wire 118) and shifting of closing and compensation piston 70, as illustrated in FIG. 16.

In this configuration, the expanded portions 102, 104 and their corresponding seals 106, 108 have been moved into sealing engagement with portions of the surrounding wall surface forming corresponding piston passage 74. As a result, communication between the base pipe interior 56 and the packer interior 50 is closed. Because of the position of expanded portion 102 and corresponding seal 106 and because of the configuration of the wall surface forming corresponding piston passage 74, communication between annulus 52 and packer interior 50 also remains closed. In this position, piston locking device 110 is activated to a position interacting with expanded portion 100, thus preventing movement of closing and compensation piston 70 back to its original position. Due to the positioning and sealing of seals 80, 106, 108, pressure in passage 124 is not released through valve 62 and thus fluid under pressure remains trapped within interior 50 of packer 34.

Figure 17:
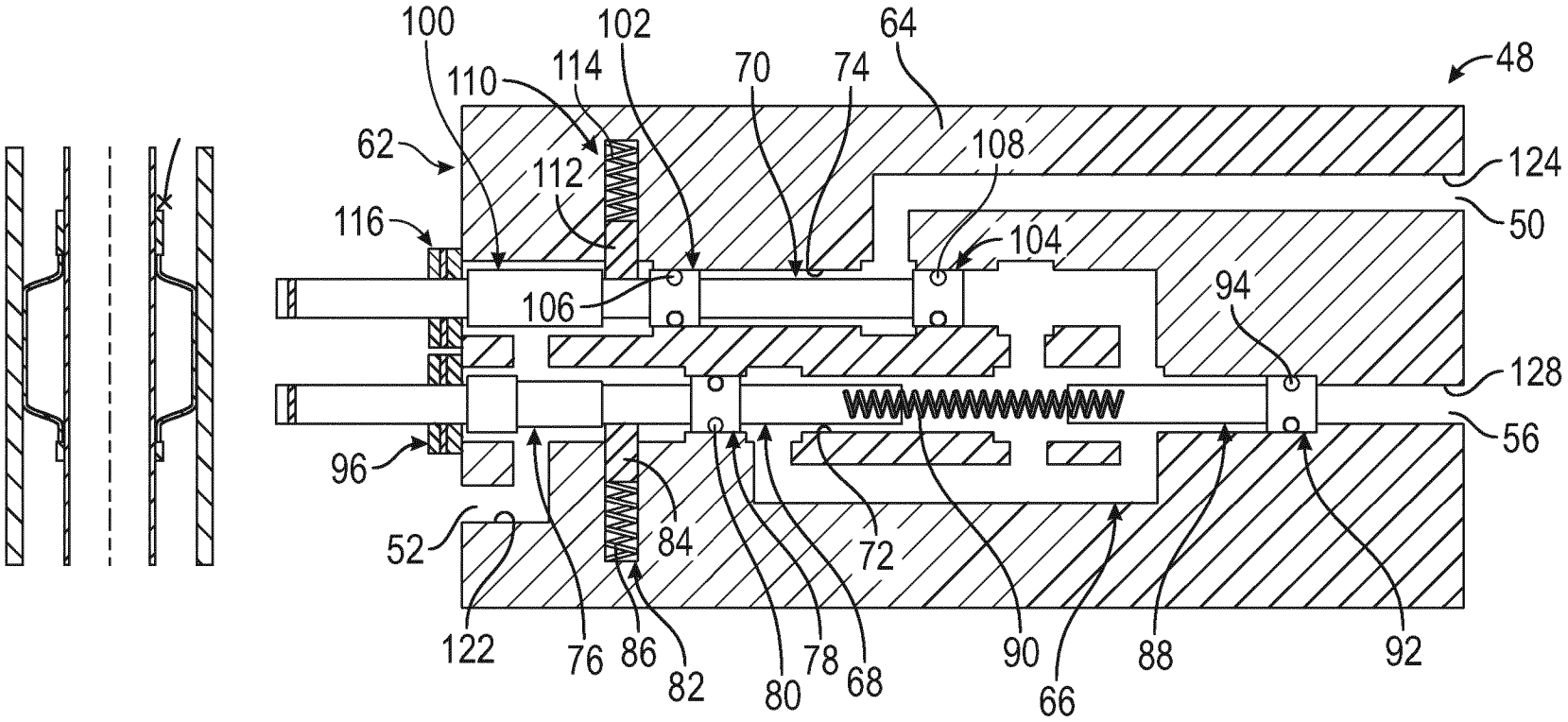
FIG. 17 is a schematic illustration similar to that of FIG. 16 but with the pressure control device in a different operational position, according to an embodiment of the disclosure.

When the pressure within base pipe interior 56 of base pipe 36 is released, the spring member 90 shifts check valve 88 and its seal 94 back into sealing engagement with the surrounding wall surface of corresponding piston passage 72, as illustrated in FIG. 17. However, fluid remains trapped within interior 50 of packer 34.

The valve 62 facilitates use of expandable metal packer 34 as an isolation device in a variety of operations and environments which may be subjected to high differential pressures. For example, the expandable metal packer 34 may be used in well applications and in other applications in which isolation between sections of a tubular structure is desired. The expandable metal packer 34 may be constructed with various types and sizes of expandable metal sleeves 40 depending on the parameters of a given operation. In a variety of well applications, the expandable metal sleeve 40 may be formed from a plastically deformable metal membrane, bladder, or other metal structure which may be radially expanded via fluid pressure.

Similarly, the pressure control device 48 may comprise various components positioned at various locations along packer 34. In a variety of applications, the pressure control device 48 may comprise valve 62. However, the specific structure and materials of valves 62 may be selected according to the parameters of a given use and/or environment. For example, the valve 62 may comprise various types of pistons, seals, springs, piston housings, and/or other components. The relative surface areas provided by the pistons/seals and corresponding piston passages may be selected according to the anticipated pressures and the desired operation of the valve 62 and packer 34. The overall tubing string 38 also may utilize many types of components and have various configurations suited for the operation and environment in which it is utilized.

Although a few embodiments of the disclosure have been described in detail above, those of ordinary skill in the art will readily appreciate that many modifications are possible without materially departing from the teachings of this disclosure. Accordingly, such modifications are intended to be included within the scope of this disclosure as defined in the claims.

What is claimed is:

1. A system for use in a well, comprising:

a tubing string having a base pipe with a base pipe interior, the tubing string being disposed in a borehole such that an annulus is established between the tubing string and a surrounding wall surface; and an expandable metal packer mounted around the base pipe, the expandable metal packer having an expandable metal sleeve mounted along the base pipe via extremities, the expandable metal packer further having a pressure control device, the pressure control device being actuatable to different flow positions via application of pressure inputs along the base pipe interior, the pressure control device comprising:

a valve held in a first flow position allowing fluid communication between the annulus and a packer interior and preventing fluid communication between the base pipe interior and the packer interior while the tubing string is run into the borehole, wherein the valve is actuatable to a second flow position, the second flow position preventing fluid communication between the annulus and the packer interior and allowing fluid communication between the base pipe interior and the packer interior to enable expansion of the expandable metal sleeve, and wherein the valve comprises:

a first piston disposed in a first passage and configured to control fluid flow between the base pipe interior and the first passage; and a second piston disposed in a second passage and configured to control fluid flow from the base pipe interior to the packer interior through the first passage.

2. The system as recited in claim 1, wherein the valve is actuatable to a subsequent flow position via a subsequent pressure input after expansion of the expandable metal sleeve, the subsequent flow position preventing fluid communication between the base pipe interior and the packer interior.

3. The system as recited in claim 2, wherein the subsequent flow position allows fluid communication between the annulus and the packer interior.

4. The system as recited in claim 2, wherein the subsequent flow position traps fluid pressure in the packer interior.

5. The system as recited in claim 2, wherein the valve comprises a hydraulic circuit located in a valve housing.

6. The system as recited in claim 1, wherein the first piston and the second piston are initially held in place by a first retention member and a second retention member, respectively.

7. The system as recited in claim 6, wherein the first retention member releases the first piston upon application of pressure at a first preset pressure level.

8. The system as recited in claim 7, wherein the second retention member releases the second piston upon application of a subsequent pressure at a second preset pressure level.

9. The system as recited in claim 1, wherein the first piston and the second piston are configured to control fluid flow between the annulus and the packer interior through the first passage and the second passage.

10. A system for use in a well, comprising:

a base pipe having a base pipe interior; and a packer mounted around the base pipe, the packer having an expandable metal sleeve mounted along the base pipe via extremities, the packer further having a pressure control device, the pressure control device being actuatable to different flow positions via application of pressure inputs along the base pipe interior, the pressure control device comprising:

a valve held in a first flow position allowing fluid communication between an annulus external to the packer and a packer interior located within the expandable metal sleeve, the valve being held in an operational position preventing fluid communication between the base pipe interior and the packer interior while the packer is deployed, wherein the valve is actuatable to a second flow position, the second flow position preventing fluid communication between the annulus and the packer interior and allowing fluid communication between the base pipe interior and the packer interior to enable expansion of the expandable metal sleeve, wherein the valve comprises:

a first piston disposed in a first passage and configured to control fluid flow between the base pipe interior and the first passage; and a second piston disposed in a second passage and configured to control fluid flow from the base pipe interior to the packer interior through the first passage.

11. The system as recited in claim 10, wherein the base pipe is mounted in a tubing string deployed in a wellbore.

12. The system as recited in claim 10, wherein the valve is actuatable to a subsequent flow position via a subsequent pressure input along the base pipe interior after expansion of the expandable metal sleeve, the subsequent flow position preventing fluid communication between the base pipe interior and the packer interior.

13. The system as recited in claim 12, wherein the subsequent flow position allows fluid communication between the annulus and the packer interior.

14. The system as recited in claim 12, wherein the subsequent flow position traps fluid pressure in the packer interior.

15. The system as recited in claim 10, wherein the first piston and the second piston are initially held in place by a first retention member and a second retention member, respectively.

16. A method, comprising:

positioning a packer along a base pipe of a tubing string;

running the tubing string into a wellbore;

using a pressure control device of the packer to maintain fluid communication between an annulus surrounding the tubing string and an interior of the packer during running of the tubing string into the wellbore;

applying a pressure input to an interior of the base pipe to transition the pressure control device to a position preventing fluid communication between the annulus and the interior of the packer while opening up fluid communication between the interior of the base pipe and the interior of the packer; and directing, via a valve, fluid into the interior of the packer to expand a metal sleeve of the packer, thus placing the packer into sealing engagement with a surrounding wall, wherein the valve comprises:

a first piston disposed in a first passage and configured to control fluid flow between the base pipe interior and the first passage; and a second piston disposed in a second passage and configured to control fluid flow from the base pipe interior to the packer interior through the first passage.

17. The method as recited in claim 16, further comprising applying a subsequent pressure input to the interior of the base pipe to transition the pressure control device to a position preventing fluid communication between the interior of the base pipe and the interior of the packer.

18. The method as recited in claim 17, wherein applying the subsequent pressure input further comprises opening up fluid communication between the annulus and the interior of the packer.

19. The method as recited in claim 17, wherein applying the subsequent pressure input further comprises trapping fluid under pressure within the interior of the packer.

* * * * *